US011226587B2

(12) United States Patent
Ishikawa et al.

(10) Patent No.: US 11,226,587 B2
(45) Date of Patent: Jan. 18, 2022

(54) IMAGE FORMING APPARATUS INCLUDING A BLOWER TO BLOW AIR ON A ROLLER NOT USED IN CONVEYANCE OF A RECORDING MEDIUM IN SIMPLEX PRINTING

(71) Applicants: Taisuke Ishikawa, Kanagawa (JP); Junichi Murano, Saitama (JP); Hiroki Ishimitsu, Kanagawa (JP)

(72) Inventors: Taisuke Ishikawa, Kanagawa (JP); Junichi Murano, Saitama (JP); Hiroki Ishimitsu, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/028,220

(22) Filed: Sep. 22, 2020

(65) Prior Publication Data

US 2021/0096508 A1 Apr. 1, 2021

(30) Foreign Application Priority Data

Sep. 30, 2019 (JP) ..... JP2019-178538

(51) Int. Cl.
*G03G 21/20* (2006.01)
*G03G 15/00* (2006.01)

(52) U.S. Cl.
CPC ..... *G03G 21/206* (2013.01); *G03G 15/80* (2013.01); *G03G 21/203* (2013.01)

(58) Field of Classification Search
CPC ..... G03G 21/203
See application file for complete search history.

(56) References Cited

U.S. PATENT DOCUMENTS

2007/0059012 A1* 3/2007 Tomine ..... G03G 21/206 399/69
2011/0064449 A1 3/2011 Shimizu
2015/0338796 A1 11/2015 Koga
(Continued)

FOREIGN PATENT DOCUMENTS

JP 2008-132649 6/2008
JP 2011-059512 3/2011
(Continued)

OTHER PUBLICATIONS

JP_2018049115_A_T MachineTranslation, Japan, Mar. 2018, Kawata et al.*
Extended European Search Report dated Feb. 9, 2021.

*Primary Examiner* — Victor Verbitsky
(74) *Attorney, Agent, or Firm* — Harness, Dickey & Pierce, P.L.C.

(57) ABSTRACT

An image forming apparatus includes a housing, a conveying member not used in simplex printing, a duct, a blower, and control circuitry. The duct includes an intake and an opening. The intake is disposed at a first end of the duct. The intake sucks air from outside of the image forming apparatus. The opening is disposed at a second end of the duct different from the first end of the duct. The duct is disposed opposite the conveying member. The blower is disposed in the duct. The blower blows air sucked from the intake to the conveying member through the opening. The control circuitry controls the blower to blow air to the conveying member at least in the simplex printing.

11 Claims, 10 Drawing Sheets

(56) References Cited

U.S. PATENT DOCUMENTS

| | | | | |
|---|---|---|---|---|
| 2018/0292782 | A1* | 10/2018 | Nojima ..... | G03G 15/2017 |
| 2019/0278222 | A1 | 9/2019 | Ishikawa | |

FOREIGN PATENT DOCUMENTS

| | | |
|---|---|---|
| JP | 2011-081074 | 4/2011 |
| JP | 2013-064789 | 4/2013 |
| JP | 2014-139643 | 7/2014 |
| JP | 2015-079182 | 4/2015 |
| JP | 2018-049115 A | 3/2018 |

* cited by examiner

IMAGE FORMING APPARATUS INCLUDING A BLOWER TO BLOW AIR ON A ROLLER NOT USED IN CONVEYANCE OF A RECORDING MEDIUM IN SIMPLEX PRINTING

CROSS-REFERENCE TO RELATED APPLICATION

This patent application is based on and claims priority pursuant to 35 U.S.C. § 119(a) to Japanese Patent Application No. 2019-178538, filed on Sep. 30, 2019, in the Japan Patent Office, the entire disclosure of which is hereby incorporated by reference herein.

BACKGROUND

Technical Field

Embodiments of the present disclosure relate to an image forming apparatus.

Description of the Related Art

There is known a technique that reduces generation of an abnormal image caused by moisture adhering to a conveying member in an image forming apparatus. For example, there is known a configuration in which airflow generators are provided on a shaft of duplex reverse rollers to take air in a sheet ejection unit inside an apparatus to take measures against an abnormal image due to condensation. However, the air in the sheet ejection unit contains a large amount of water vapor, and there is a problem that sufficient measures may not be taken.

SUMMARY

In an aspect of the present disclosure, an image forming apparatus includes a housing, a conveying member not used in simplex printing, a duct, a blower, and control circuitry. The duct includes an intake and an opening. The intake is disposed at a first end of the duct. The intake sucks air from outside of the image forming apparatus. The opening is disposed at a second end of the duct different from the first end of the duct. The duct is disposed opposite the conveying member. The blower is disposed in the duct. The blower blows air sucked from the intake to the conveying member through the opening. The control circuitry controls the blower to blow air to the conveying member at least in the simplex printing.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
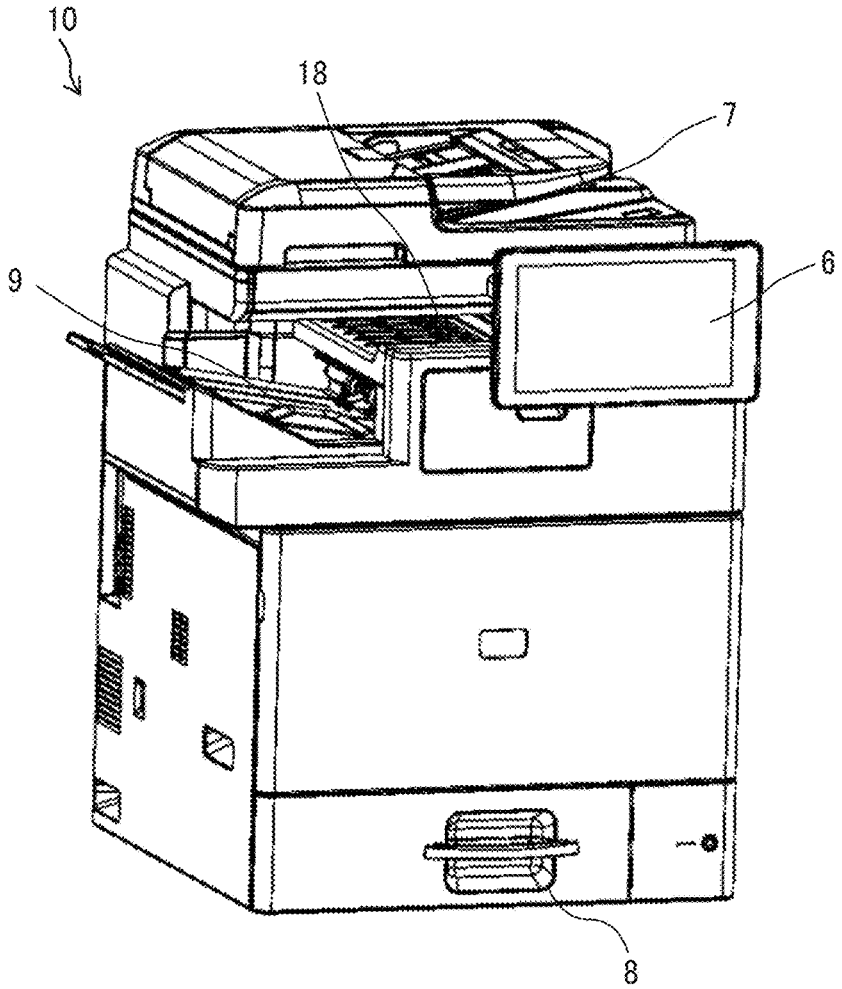
FIG. 1 is an external view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiments of the present disclosure are described below with reference to the drawings. For clarity, some of following descriptions and drawings may be appropriately omitted or simplified. In the drawings, the same reference numerals are given to same components and corresponding parts having the same configurations or functions, and redundant descriptions thereof will be omitted.

According to an embodiment of the present disclosure, a duct is provided to be open in the vicinity of conveying members to blow outside air to the conveying members to reduce adhesion of water droplets to the conveying members that convey a recording medium. Specifically, a configuration of directly blowing air with a small amount of water vapor to the conveying members is used to reduce the adhesion of the water droplets to the conveying members. Thus, the amount of water vapor in the air in the vicinity of the conveying members can be reliably reduced, and the adhesion of water droplets to the conveying members can be prevented. An image with dew condensation is most noticeable when water droplets adhere to conveying members (for example, conveyance rollers used only in duplex printing) that are not used in simplex printing. For this reason, it is preferable to reduce adhesion of water droplets to the conveying members, particularly in simplex printing. The above-described embodiment of the present disclosure is described in detail with reference to the drawings.

Figure 2:
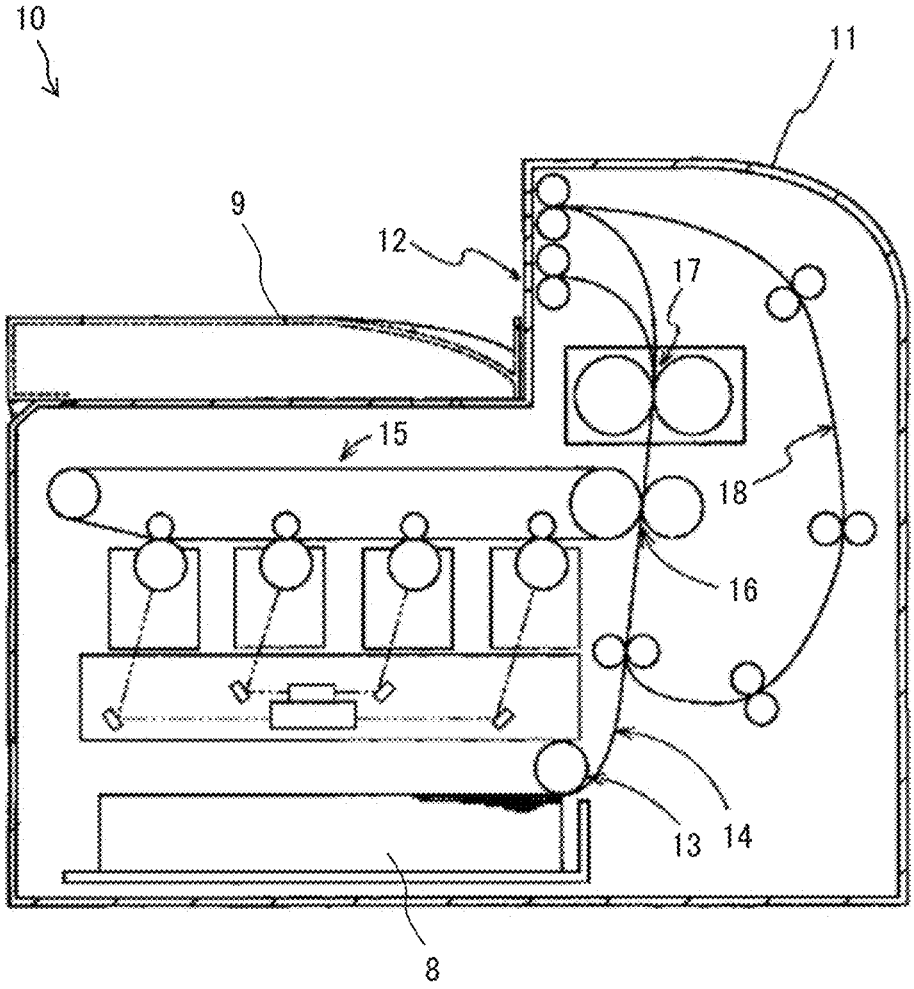
FIG. 2 is a schematic view of an example of an internal configuration of the image forming apparatus of FIG. 1.

First, with reference to FIGS. 1 and 2, an outline of an image forming apparatus according to an embodiment of the present disclosure is described. FIG. 1 is an external view of the image forming apparatus 10 according to the present embodiment. The image forming apparatus 10 includes an operation panel 6, an auto document feeder (ADF) 7, a recording medium supply tray 8, a recording medium ejection tray 9, and a duplex reverse unit 18. The ADF 7 feeds and conveys an original document. The recording medium supply tray 8 stores recording media in a stackable manner before image recording is performed on the recording media. The recording medium ejection tray 9 to which a recording medium onto with a recorded image is ejected.

FIG. 2 is a schematic view of an example of an internal configuration of the image forming apparatus of FIG. 1. The image forming apparatus 10 includes a housing 11, a recording medium ejection device 12, a recording medium supply unit 13, a recording medium conveyance path 14, a toner image forming device 15, a transfer device 16, a fixing device 17 (also referred to as a "fixing unit"), and a duplex reverse unit 18. The recording medium ejection device 12 is provided on a top surface of the housing 11 and ejects a recording medium on which an image is recorded to the recording medium ejection tray 9. The recording medium supply unit 13 feeds recording media from the recording medium supply tray 8 on a sheet-by-sheet basis. The recording medium conveyance path 14 is formed so as to connect the recording medium supply unit 13 and the recording medium ejection device 12 to convey the recording medium. The toner image forming device 15 is provided between the recording medium supply unit 13 and the recording medium ejection device 12, and forms a toner image based on image data. The transfer device 16 transfers the toner image, which has been formed by the toner image forming device 15 to the recording medium on the recording medium conveyance path 14. The fixing device 17 (also referred to as a "fixing unit") is provided between the transfer device 16 and the recording medium ejection device 12, and fixes the toner image onto the recording medium, to which the toner image has been transferred, under pressure and heat. The duplex reverse unit 18 is connected to the recording medium conveyance path 14 so as to straddle the transfer device 16 and the fixing device 17, and reverses the recording medium.

The image forming apparatus 10 having the above-described configuration performs image recording by a process in which the toner image formed based on image data is transferred and fixed onto the recording medium and the recording medium is ejected from the recording medium ejection device 12 on the top surface to the recording medium ejection tray 9.

Next, an embodiment of the present disclosure is described. Hereinafter, a sheet of paper is described as an example of the recording medium. The recording medium may be an overhead projector (OHP) sheet, an OHP film, a cloth, or the like other than the sheet of paper. In addition, the sheet may be a thick paper, a postcard, an envelope, a thin paper, a coated paper (a coated paper, an art paper, or the like), an uneven paper such as Japan paper, a tracing paper, or the like, in addition to a plain paper.

A main part of an image forming apparatus according to an embodiment of the present disclosure is described with reference to FIG. 3.

Sheet conveyance passage in image formation In an image forming apparatus 10 according to the present embodiment, when simplex printing is performed, a sheet is fed, registered, and transferred. Then, the sheet is conveyed to the recording medium ejection device 5 serving as a sheet ejection area via a fixing unit 20, pairs of vertical conveyance rollers 31*a* and vertical conveyance rollers 31*b*, a lower portion of a bifurcating claw 34, and pairs of sheet ejection rollers 32*a* and a sheet ejection roller 32*b*. The sheet ejected from an ejection exit 51 as a recording medium outlet is stacked on a sheet ejection tray 50. The image forming apparatus 10 causes a sheet to pass through the fixing unit 20 after the sheet feeding, the registration, and the transfer, to form and fix an image on a first surface of the sheet. In this step, the sheet is sequentially conveyed from a conveyance path a to a conveyance path b (i.e. in the order of the conveyance path a and the conveyance path b).

When duplex printing is performed, a sheet is fed, registered, and transferred. After passing through the fixing unit 20 and the pairs of vertical conveyance rollers 31*a* and vertical conveyance rollers 31*b*, the sheet passes above the bifurcating claw 34 and is conveyed to the sheet reversing port 52 as a recording medium reversing port by pairs of a duplex reverse rollers 33*a* and duplex reverse rollers 33*b*. After the sheet passes through the fixing unit 20 after the sheet feeding, the registration, and the transfer, the image forming apparatus 10 forms and fixes an image on the first surface of the sheet. In this step, the sheet is sequentially conveyed from the conveyance path a to the conveyance paths c and d (in the order of the conveyance path a, the conveyance path c, and the conveyance path d).

The image forming apparatus 10 confirms that the sheet has reached a predetermined position by a sheet end detection sensor, and reversely rotate the duplex reverse rollers 33*a* to switch back the sheet. After the switchback, the sheet passes through the conveyance path e (in the order of the conveyance path d and the conveyance path e) and enters the registration step and the transfer step again. The image forming apparatus 10 forms and fixes an image on a second surface of the sheet. After the image is fixed on the second surface of the sheet, the sheet is sequentially conveyed from the conveyance path a to the conveyance path b and stacked on the sheet ejection tray 50, as in the case of simplex printing.

Mechanism of occurrence of dew condensation image When duplex printing is performed immediately after simplex printing, white spots due to water droplets may occur on the second surface of the sheet in the duplex printing. When simplex printing is continuously performed, a large amount of water vapor is released from sheets heated by the fixing unit 20. The water vapor diffuses inside of the image forming apparatus 10 in accordance with the conveyance of the sheets and a natural upward air flow. As a result, a large amount of water droplets adhere mainly to vicinities of the conveyance paths a and b. In addition, water droplets are likely to adhere to the conveyance path d, the duplex reverse rollers 33*a*, and the duplex reverse rollers 33*b*, which are present above the conveyance path b. When the simplex printing is continued, the water droplets on the conveyance paths a and b, the vertical conveyance rollers 31*a*, and the vertical conveyance rollers 31*b* decrease because the water droplets are wiped by continuous passing of the sheets and the conveying members receive the heat of the sheets and are heated.

However, the conveyance path d, the duplex reverse rollers 33*a*, and the duplex reverse rollers 33*b* are still cold, and the adhesion of the water droplets increases. If duplex printing is performed in such a state immediately after simplex printing, the sheet with the image fixed on the first surface is sandwiched between the duplex reverse rollers 33*a* and the duplex reverse rollers 33*b* containing a large amount of the water droplets when the sheet with the image fixed on the first surface passes through the conveyance path d. Accordingly, the water droplets are transferred to the sheet. Then, when the sheet is switched back at the sheet reversing port 52 and an image is transferred onto the second surface of the sheet through the conveyance path e, toner on a portion of the sheet including water droplets is removed. Hereinafter, the image of abnormal quality having white spots due to the water droplets is referred to as a "condensation image".

In general, as a characteristic of adherence of water droplets, the influence of the water droplets on pairs of conveyance rollers is more conspicuous in the condensation image than the influence of the water droplets on conveyance ribs. A conveyance guide plate includes ribs and is disposed horizontally with respect to a direction of conveyance of the sheet. For this reason, if water droplets on the conveyance guide plate are transferred onto a sheet, the water droplets become thin lines and are less noticeable. On the other hand, when a sheet passes through the pairs of conveyance rollers, the sheet is sandwiched by the pairs of conveyance rollers, the water droplets corresponding to the widths of the conveyance rollers adhere to the sheet. In addition, each of the pairs of conveyance rollers rotate in close contact with each other. Accordingly, when water droplets adhere to the pairs of conveyance rollers, the adhesion of the water droplets to the sheet is highly likely.

Therefore, reliably removing the water droplets from the pairs of the conveyance rollers is effective to take measures against the dew condensation image.

Configuration example of image forming apparatus according to an embodiment of the present disclosure An image forming apparatus according to an embodiment of the present disclosure includes conveying members that are not used in simplex printing, and includes at least a duct, a blower, and a controller to solve the above-described disadvantages. The duct includes an intake to suck air from outside of the image forming apparatus and an opening provided at an end of a housing different from the intake and facing the conveying members. The blower is provided in the duct, and blows air sucked from the intake to the conveying members through the opening. The controller controls the blower to blow air to the conveying members at least during simplex printing. The controller, for example, operates the blower at least during simplex printing. The controller will be described later with reference to FIG. 6.

In the configuration example of FIG. 3, the image forming apparatus 10 includes the pairs of duplex reverse rollers 33*a* and duplex reverse rollers 33*b* as the conveying members, a blower duct 4 as the duct, a blower 42 as the blower a blower duct intake 43 (hereinafter referred to as "intake") as the intake, and blower duct exhaust ports 41 (hereinafter referred to as "exhaust port") as the openings.

Here, the conveying members that are not employed in simplex printing (hereinafter also referred to as a "conveying members not used in simplex printing" as appropriate) according to an embodiment of the present disclosure are members that convey a recording medium and are not used during simplex printing (for example, conveying members through which a recording medium does not pass). The conveying members not used in simplex printing are, for example, a pair of rollers (for example, a combination of a roller and another roller) used only in duplex printing, and may be either a driving roller or a driven roller. The conveying members not used in simplex printing are, for example, a member such as a belt, which is not used in simplex printing but used in duplex printing, to convey a recording medium or conveying members (pairs of a roller and another roller, a belt, or the like) used in post-processing (folding, stapling, bookbinding, sorting, or the like) after an image is formed on a recording medium.

The openings are provided at positions facing the respective conveying members. Each of the openings is preferably provided in the vicinity of the corresponding conveying member, and is preferably provided, for example, at a position at which air exhausted from the corresponding opening of the duct by the blower is directly blown to the conveying member. Each of the openings is provided at a position at which air is directly blown to at least a part of the corresponding conveying member. Further, each of the openings is preferably provided so that a portion (area) of the corresponding conveying members to which air can be directly blown is large. For example, when the conveying members are a pair of rollers, each of the openings is provided at a position at which air is directly blown at least to a portion of at least one of the pair of rollers. Further, the opening is preferably provided at a position at which wind is directly blown at least a part of the pair of rollers.

In an embodiment described below, the duplex reverse rollers 33*a* and the duplex reverse rollers 33*b* illustrated in FIG. 3, as an example of conveying members that are not used in simplex printing, are used to describe a detailed configuration example.

Figure 3:
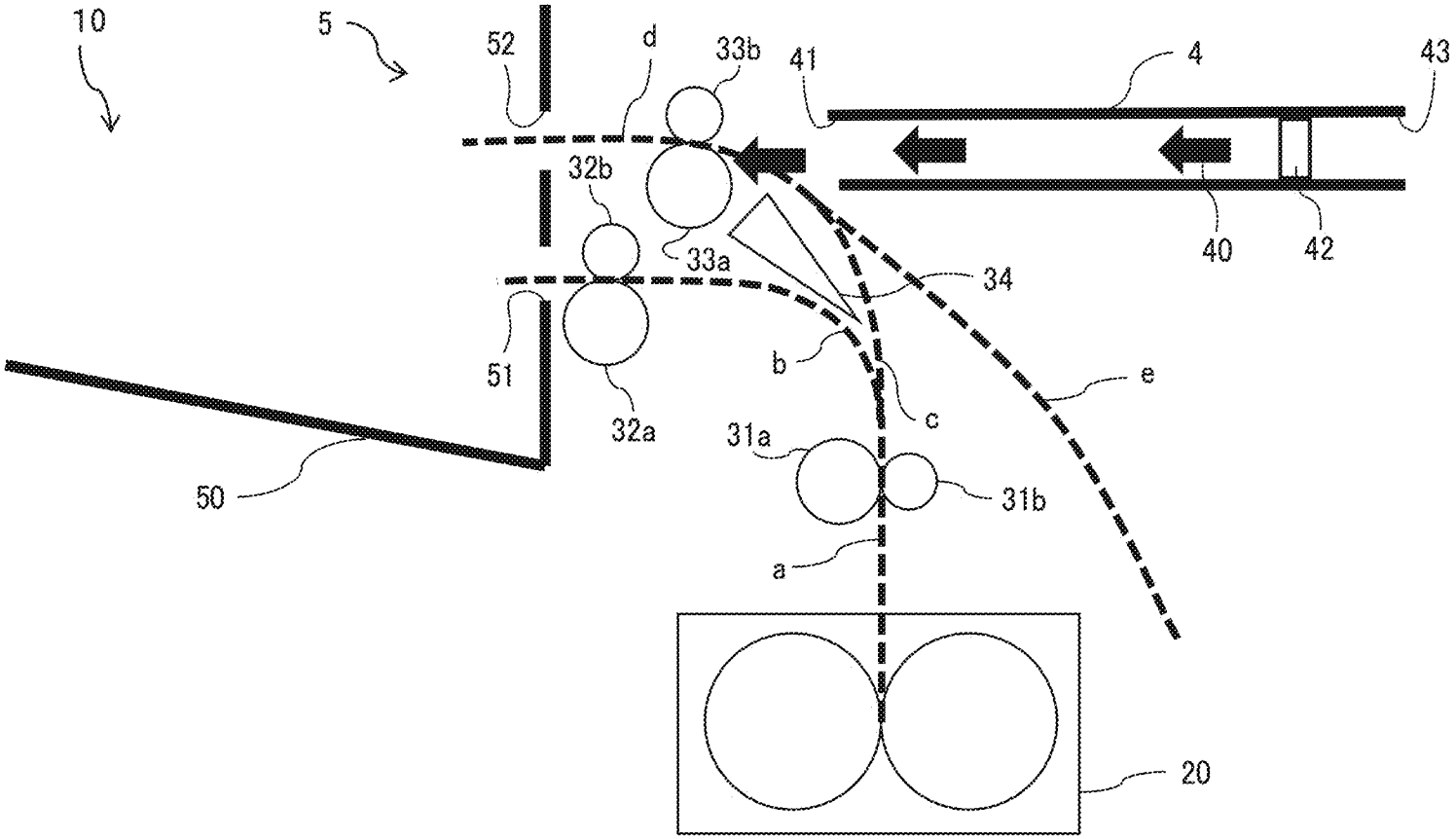
FIG. 3 is a schematic diagram of a main part of an image forming apparatus according to an embodiment of the present disclosure.

In the configuration example illustrated in FIG. 3, the blower duct 4 is provided, and air flows 40 to blow air to the conveying member are generated by the blower 42. Further, each pair of duplex reverse rollers 33*a* and duplex reverse rollers 33*b* is arranged in the vicinity of the corresponding exhaust port 41 to prevent condensation of the duplex reverse rollers 33*a* and the duplex reverse rollers 33*b*. During simplex printing, water vapor is sprinkled on the duplex reverse rollers 33*a* and the duplex reverse rollers 33*b*, and at the same time, the air flows 40 are also blown to the duplex reverse rollers 33*a* and the duplex reverse rollers 33*b*. Such a configuration can prevent water droplets from adhering to the duplex reverse rollers 33*a* and the duplex reverse rollers 33*b*. Thus, generation of the condensation image can be prevented in duplex printing performed after simplex printing.

Figure 4:
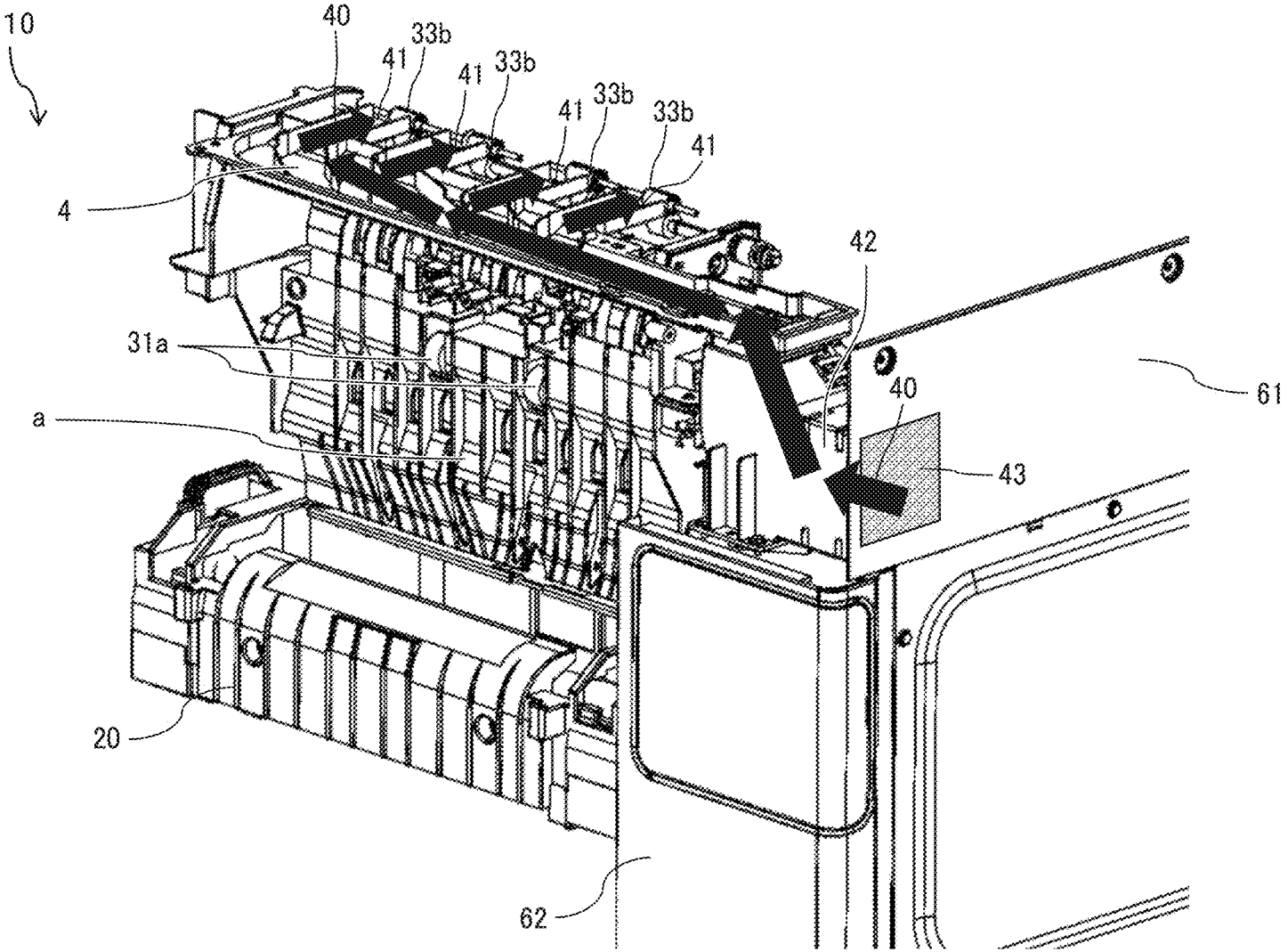
FIG. 4 is a perspective view of a configuration example of a blower duct.

Next, with reference to FIG. 4, an arrangement example of the blower duct 4 is described. FIG. 4 is a perspective view of a part of the image forming apparatus 10, in which a top surface of the image forming apparatus 10 is removed so that the inside of the blower duct 4 is visible. The periphery of the blower duct 4 is surrounded by the top surface of the image forming apparatus 10, and the blower 42 flows air in the blower duct 4. In FIG. 4, a part of a side of the image forming apparatus 10 is removed so that the inside of the image forming apparatus 10 is visible.

FIG. 4 illustrates an example in which the exhaust ports 41 are disposed in the vicinities of the respective duplex reverse rollers 33*b*. The air flow 40 that blows air can be generated by the blower 42 disposed inside the blower duct 4. In this example, an axial flow fan motor is used as the blower 42. A sirocco fan or the like may be used as the blower 42. Outside air is sucked from the intake 43 provided on an image forming apparatus rear side 61 and is blown to the duplex reverse rollers 33*b*. The amount of water vapor in the outside air is lower than the air above the fixing unit 20 containing a large amount of water vapor. Thus, blowing the outside air is effective to prevent dew condensation.

The blower duct 4 includes the single intake 43 at one end of the blower duct 4 and the plurality of exhaust ports 41 at the other end of the blower duct 4. The plurality of duplex reverse rollers 33*b* are provided so as to extend in a lateral direction with respect to the conveyance direction of the sheet. FIG. 4 illustrates an example in which the number of the duplex reverse rollers 33*b* provided is four. Preferably the blower duct 4 includes the plurality of exhaust ports 41 (four exhaust ports 41 in FIG. 4) provided so that the exhaust ports 41 correspond to the respective duplex reverse roller 33*b* to blow air uniformly to the respective duplex reverse roller 33*b*.

In FIG. 4, the intake 43 is provided on the image forming apparatus rear side 61. The intake 43 is preferably disposed on the image forming apparatus rear side 61 because the amount of water vapor around the image forming apparatus rear side 61 is smaller than the amount of water vapor around other sides. However, embodiments of the present disclosure are not limited thereto, and the intake 43 may be provided on a side (for example, an image forming apparatus right side 62) of the image forming apparatus 10. At this time, since a sheet ejected from the sheet eject outlet 51 contains water vapor, the intake 43 is preferably disposed far from a position on which the sheet ejection tray 50 containing a large amount of water vapor is provided (an area on which the sheet is ejected to the sheet ejection tray 50). Although the intake 43 may be provided on the front side of the image forming apparatus 10, the intake 43 is preferably provided on another side of the image forming apparatus 10 because the user operates on the front side of the image forming apparatus 10.

Figure 5:
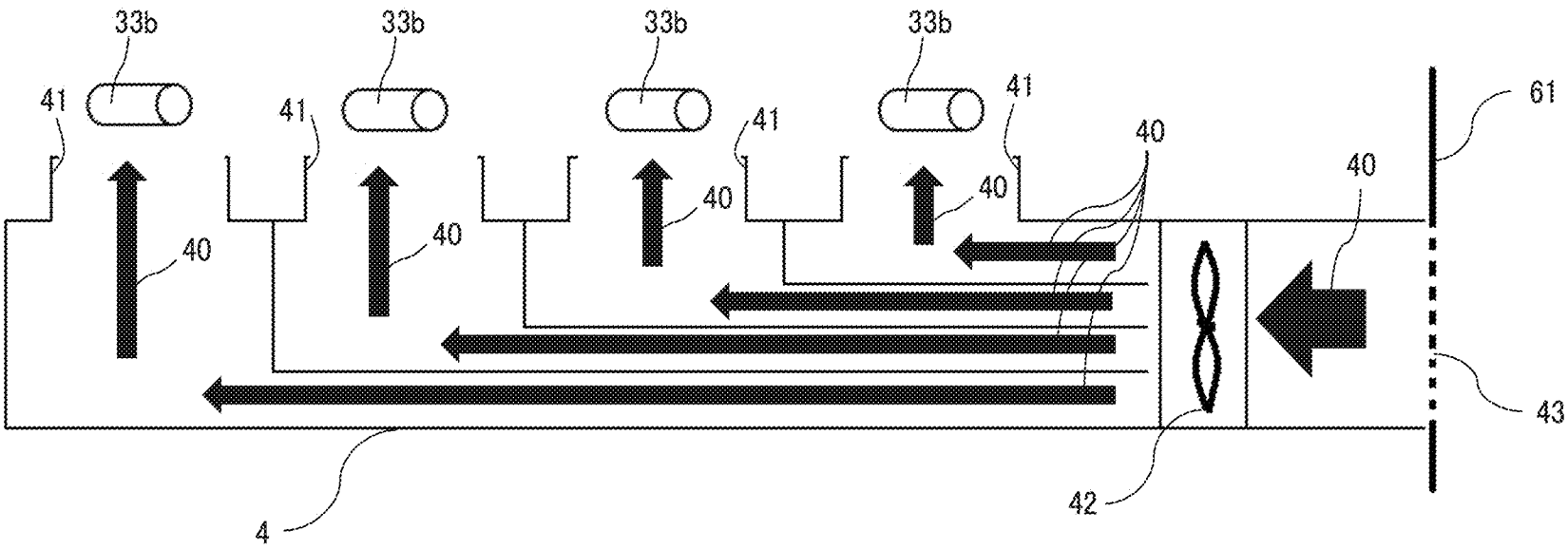
FIG. 5 is a schematic diagram of an example of the internal structure of the blower duct.

Here, an example of the internal configuration of the blower duct 4 is described with reference to FIG. 5. The blower duct 4 sucks air from the intake 43 provided on the image forming apparatus rear side 61. The blower duct 4 is divided into four flow paths after air passes through the blower 42 so that outside air is supplied to the four duplex reverse rollers 33*b*. The ratio of the cross-sectional areas of the divided flow path affects the amount of outside air supplied to the duplex reverse rollers 33*b*. Typically, optimization is performed so that the outside air can be uniformly supplied to each of the duplex reverse rollers 33*b*. However, if there is a portion to which the outside air is particularly desired to be intensively supplied, the ratio of the cross-sectional areas of the divided flow paths can also be changed to intensively supply the outside air. In this way, the effect of removing water droplets from the conveying members can be reliably and uniformly achieved without the air flow being dispersed or deflected.

In addition, installing a dedicated blower 42 for each of the duplex reverse rollers 33*b* and operating each of the dedicated blowers 42 independently can obtain a countermeasure effect against condensation. For example, the blower 42 may be provided in a duct in which the blower duct 4 is branched so as to correspond to each of the duplex reverse rollers 33*b*.

Figure 6:
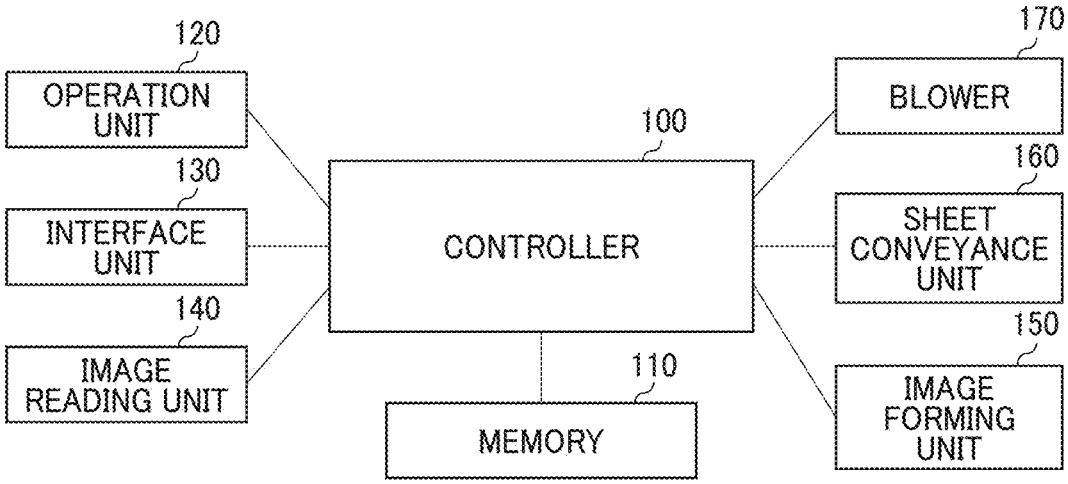
FIG. 6 is a diagram of an example of functional blocks controlled by a controller.

Operation example of controlling image forming apparatus according to an embodiment of the present disclosure Next, an operation example of controlling the blower 42 and the like in the image forming apparatus 10 is described. First, a controller included in the image forming apparatus 10 is described. The image forming apparatus 10 according to an embodiment of the present disclosure includes a controller 100 as the controller that controls the entire image forming apparatus 10 and controls execution of each function. FIG. 6 is a diagram of an example of functional blocks controlled by the controller 100. The controller 100 controls a printing operation, an image reading operation, and the like. The controller 100 controls operations of an operation unit 120, an interface (I/F) unit 130, an image reading unit 140, an image forming unit 150, a sheet conveyance unit 160, and a blower 170 by using, for example, a memory 110.

The controller 100 includes, for example, a central processing unit (CPU), a random access memory (RAM), and a read only memory (ROM). The CPU executes various programs and controls the entire image forming apparatus 10 based on arithmetic processing and control programs. The RAM is a volatile storage medium to read and write information at high speed, and functions as a work area when the CPU executes a program. The ROM is a read-only nonvolatile storage medium in which various programs and control programs are stored.

The memory 110 is a storage unit that temporarily or permanently holds data and the like under the control of the image forming apparatus 10. The operation unit 120 is a unit operated by a user to perform operations and instructions such as printing and scanning of an image. For example, the operation panel 6 of FIG. 1 can be used as the operation unit 120. The I/F unit 130 is an interface that includes a terminal capable of communicating with the outside, such as a universal serial bus (USB), a local area network (LAN), or WiFi, and transmits and receives data.

The image reading unit 140 has a function of reading documents by a scanner, an ADF, or the like and converting the read document into image data. The image forming unit 150 is a device that transfers and outputs desired image data to a recording medium when there is a print instruction. The image forming unit 150 includes, for example, a toner image forming device 15, a transfer device 16, and a fixing device 17 illustrated in FIG. 2. The sheet conveyance unit 160 is a device that conveys a recording medium to be output. The sheet conveyance unit 160 has a function of performing conveyance for simplex printing or conveyance for duplex printing in accordance with an instruction from the controller 100. The blower 170 has a function of generating an air flow (for example, a fan) in the image forming apparatus 10 for cooling, dehumidification, or the like. The above-described blower 42 is an example of the blower 170.

Figure 7:
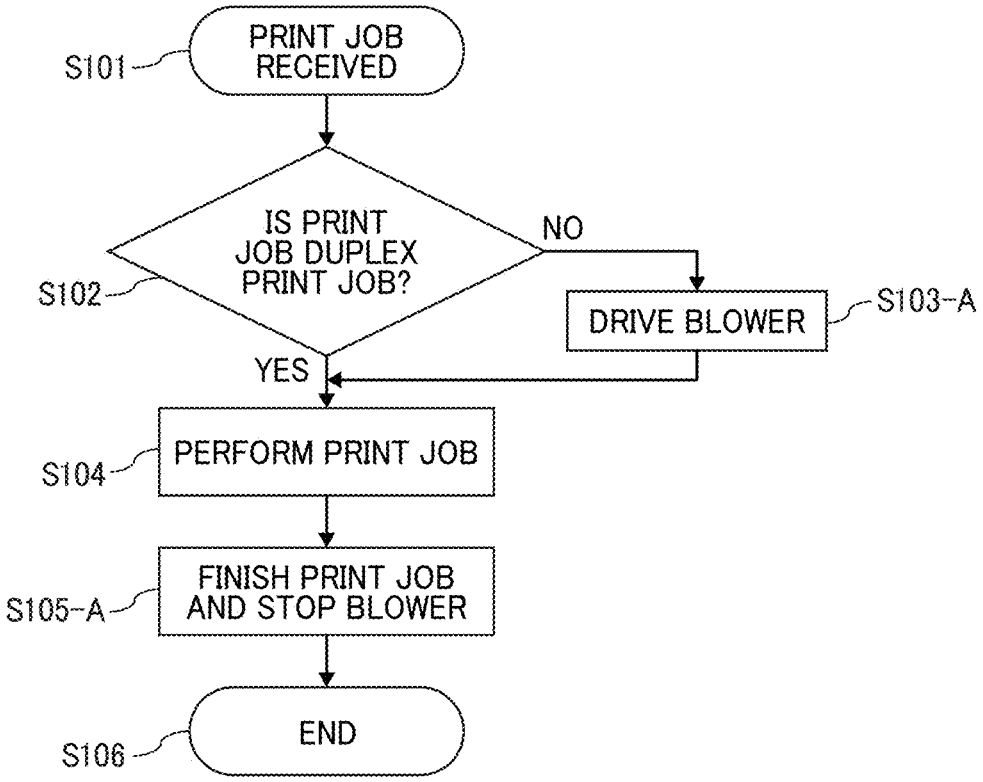
FIG. 7 is a flowchart of an operation example of controlling the operation of a blower based on a printing mode.

Hereinafter, the control of operation time of the blower 42 by the controller 100 is described. FIG. 7 is a flowchart of an operation example of controlling the operation of the blower 42 according to the printing mode. The blower 42 is assumed to be, for example, a fan. Since an increase in power consumption, an increase in noise, and the like occur when the fan is operated, shortening the operation time of the blower 42 as much as possible is desirable.

In the image forming apparatus 10, the generation of the condensation image often occurs at the time of duplex printing immediately after simplex printing. However, in a case in which duplex printing is continued, heated sheets pass through almost all of the conveyance paths. Accordingly, water droplets evaporate due to temperature, or the heated sheets absorb and are ejected as is. Thus, the condensation images are less likely to be generated. For this reason, the blower 42 is not operated during duplex printing (when the sheets pass through the duplex reverse rollers 33*a* and the duplex reverse rollers 33*b*) and the air blowing is performed only during simplex printing. Thus, the amount of moisture adhering to the target conveying members can be reduced and the operation time of the fan while eliminating the condensation image can be reduced. As described above, preventing the water droplets from being accumulated during simplex printing is effective. Accordingly, limiting the operation of the blower 42 only during simplex printing can obtain an effect of reducing power consumption and noise.

Specifically, an operation example of controlling the operation time of the blower 42 according to either duplex printing or simplex printing is described. When a print operation instruction is received via the operation unit 120, the/F unit 130, or the like, the controller 100 starts control as a received print job (S101). The controller 100 determines whether the print operation instruction is a duplex print job or a simplex print job (S102). When the print operation instruction is the simplex print job (NO in S102), the operation of the blower 42 is started (S103-A), and in a case of the duplex print job (YES in S102), the operation of the blower 42 is not performed. The image forming apparatus 10 performs a print operation (S104), and after the print operation ends, the controller 100 stops the operation of the blower 42 (S105-A) and ends the control (S106). Ina case in which print commands are continuously input to the image forming apparatus 10, the controller 100 performs the above described control for each print job command and starts over from S101.

Figure 8:
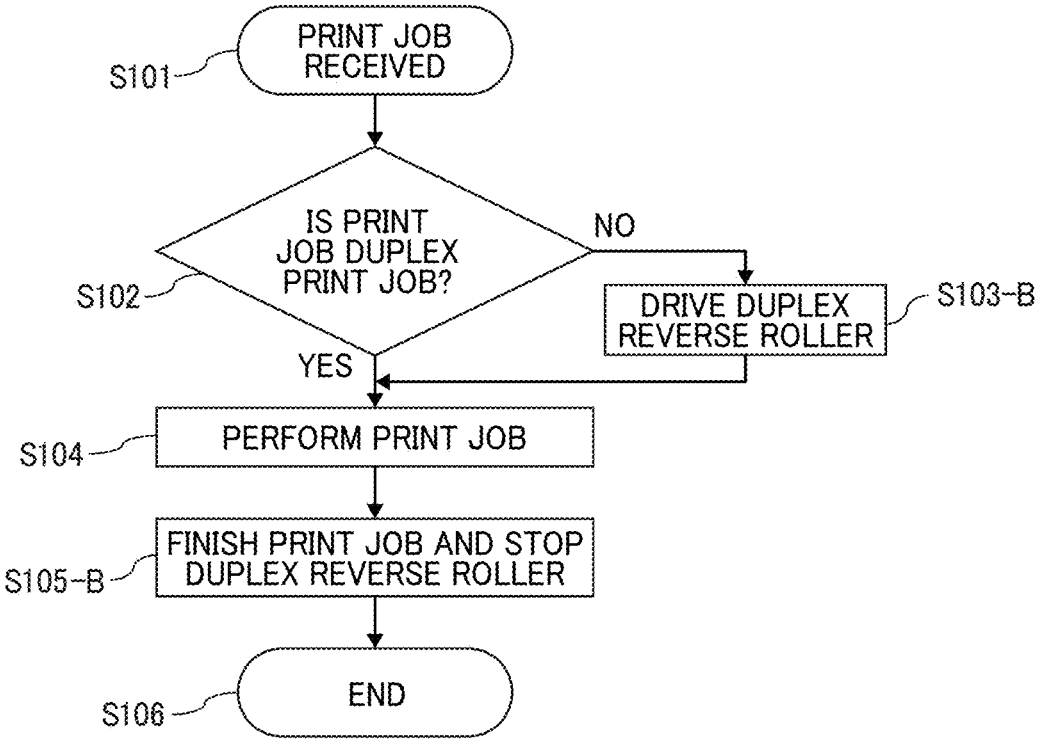
FIG. 8 is a flowchart of an operation example of driving duplex reverse rollers during simplex printing.

Next, an operation example of drive control of the conveying members is described. Here, control of the duplex reverse rollers 33*a* as an example of the conveying members is described. FIG. 8 is a flowchart of an operation example of driving the duplex reverse rollers 33*a* during simplex printing. In the image forming apparatus 10, when air is blown in one direction to the duplex reverse rollers 33*a* through the exhaust ports 41, about half of the circumference of each of the duplex reverse rollers 33*a* is hardly affected by the air. Accordingly, about the half of the circumference of each of the duplex reverse rollers 33*a* becomes a so-called dead angle and removing water droplets may be difficult. Accordingly, in a state in which the duplex reverse rollers 33*a* are stopped, the effect of removing water droplets by blowing air may not be exhibited to the maximum. Hence, the duplex reverse rollers 33*a* are driven even during duplex printing so that air can always be supplied over the entire circumference of each of the duplex reverse rollers 33*a*. Further, by rotating the duplex reverse rollers 33*a*, air can be supplied to the entire circumference of each of the duplex reverse rollers 33*a* and the duplex reverse rollers 33*b*. In addition, driving the duplex reverse rollers 33*a* and causing the duplex reverse rollers 33*b* to be driven to move each of the pairs of the duplex reverse roller 33*a* and the duplex reverse roller 33*b* enables the surrounding air to be agitated. As a result, water droplets are less likely to adhere to the pairs of the duplex reverse roller 33*a* and the duplex reverse roller 33*b*. In this way, water droplets on the duplex reverse rollers 33*a* and on the duplex reverse rollers 33*b* can be effectively removed.

Specifically, an operation example of the drive control is described. When a print operation instruction is received via the operation unit 120, the I/F unit 130, or the like, the controller 100 starts control as a received print job (S101). The controller 100 determines whether the print operation instruction is a duplex print job or a simplex print job (S102), and drives the duplex reverse rollers 33*a* when the print command is a simplex print job (NO in S102) to create a state in which the duplex reverse rollers 33*a* are always rotated during print (S103-B). On the other hand, in the case of a duplex print job (YES in S102), the duplex reverse rollers 33*a* are operated in accordance with the operation control for a normal duplex print job. The image forming apparatus 10 performs a print operation (S104). After the print operation is completed, the controller 100 stops the operation of the duplex reverse rollers 33*a* (S105-B), and ends the control (S106). Ina case in which print commands are continuously input, the controller 100 performs the above described control for each print job command and starts over from S101.

Figure 9:
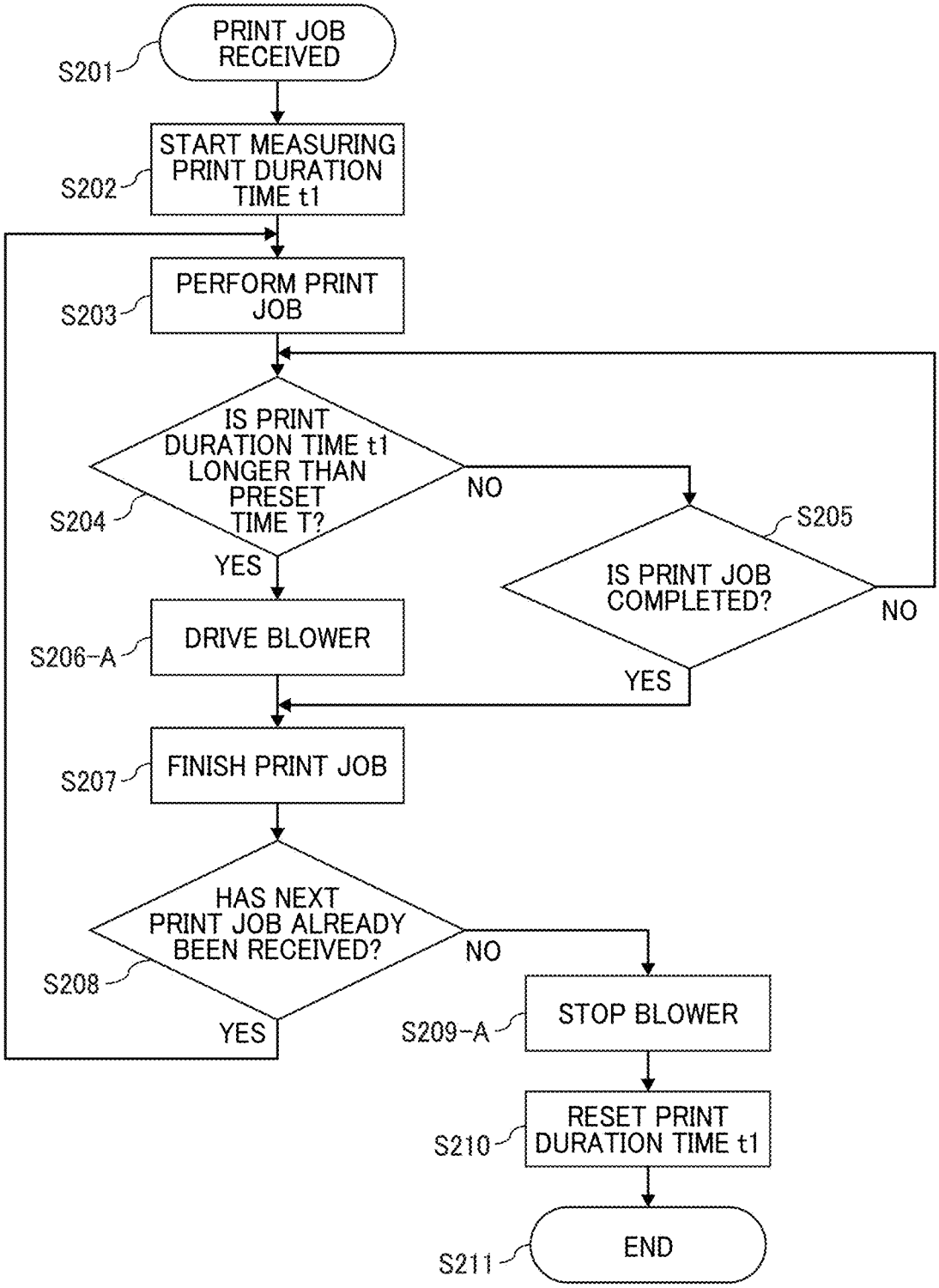
FIG. 9 is a flowchart of an operation example in which the operation of the blower is started after a preset time has elapsed.

Next, an operation example of the control of the operation start time of the blower 42 is described. FIG. 9 is a flowchart of an operation example in which the operation of the blower 42 is started after a preset time T has elapsed. When the image forming apparatus 10 prints several sheets, the amount of water vapor emitted from the sheets after fixing is smaller than the amount of water vapor emitted from the sheets in continuous printing for a long time. When a plurality of sheets are continuously printed for a long time, the adhesion of water droplets to the conveying members becomes noticeable. Therefore, it is expected that the condensation image may not occur even if the blower 42 is not operated. Accordingly, performing control such that the blower 42 is not operated for several print jobs enables to realize both prevention of an increase in noise and power consumption due to the operation of the blower 42 and prevention of the occurrence of abnormal images.

A specific operation example of the control is described with reference to FIG. 9. When the print duration time t1 exceeds the preset time T with respect to any preset time T, the blower 42 is controlled to be operated. Here, a value set in advance as the preset time T is held, for example, in a recording area or the like that can be referred to by the controller 100. The print duration time t1 is, for example, a time measured by a timer provided in the controller 100.

As in step S101 of FIGS. 7 and 8, after receiving a print job (S201), the controller 100 starts a timer to check the print duration time t1 (S202) and measures the print duration time t1. At the same time, the print operation is started (S203). The controller 100 determines whether the print duration time t1 has reached the preset time T (S204). When the print duration time t1 has not reached the preset time T (t1<T, NO in S204), the controller 100 checks whether the print is continued (S205). If the print is continued (NO in S205), the process returns to step S204 again and the print duration time t1 is compared again with the preset time T. When the print operation is completed (YES in S205), the process proceeds to step S207, and the subsequent process is performed. When the print duration time t1 has reached the preset time T (t1≥T) in step S204 (YES in S204), the controller 100 starts to operate the blower 42 (S206-A), proceeds to step S207, and performs the subsequent process. The operation of the blower 42 is continued until the end of printing. The controller 100 executes the print operation of one received print job and ends the operation (S207).

In the image forming apparatus 10, there is a case in which a plurality of print jobs is accumulated in the image forming apparatus 10 (YES in S208), the plurality of print jobs are continuously processed, and the printing may appear to be continued. In such a case, the controller 100 returns to step S203 while holding a value of the print duration time t1, and continuously executes a next print job (YES in S208). On the other hand, if there is no next print job (NO in S208), the controller 100 stops the blower 42 (S209-A), resets the print duration time t1 (S210), and ends the control (S211).

As an alternative to controlling the operation of the blower 42 based on the magnitude relation between the print duration time t1 and the preset time T a determination based on the number of prints may be used. During printing, an image quality adjustment operation or an operation failure such as a paper jam might occur, and it may be undesirable to determine the operation control of the blower 42 based on the printing duration time. Alternatively, the print duration time t1 and the preset time T in the flowchart of FIG. 9 may be replaced with the total number of prints and a reference number of prints, respectively. Thus, the operation timing of the blower 42 can be determined without being affected by the image quality adjustment operation during printing or an operation failure such as a paper jam.

Figure 10:
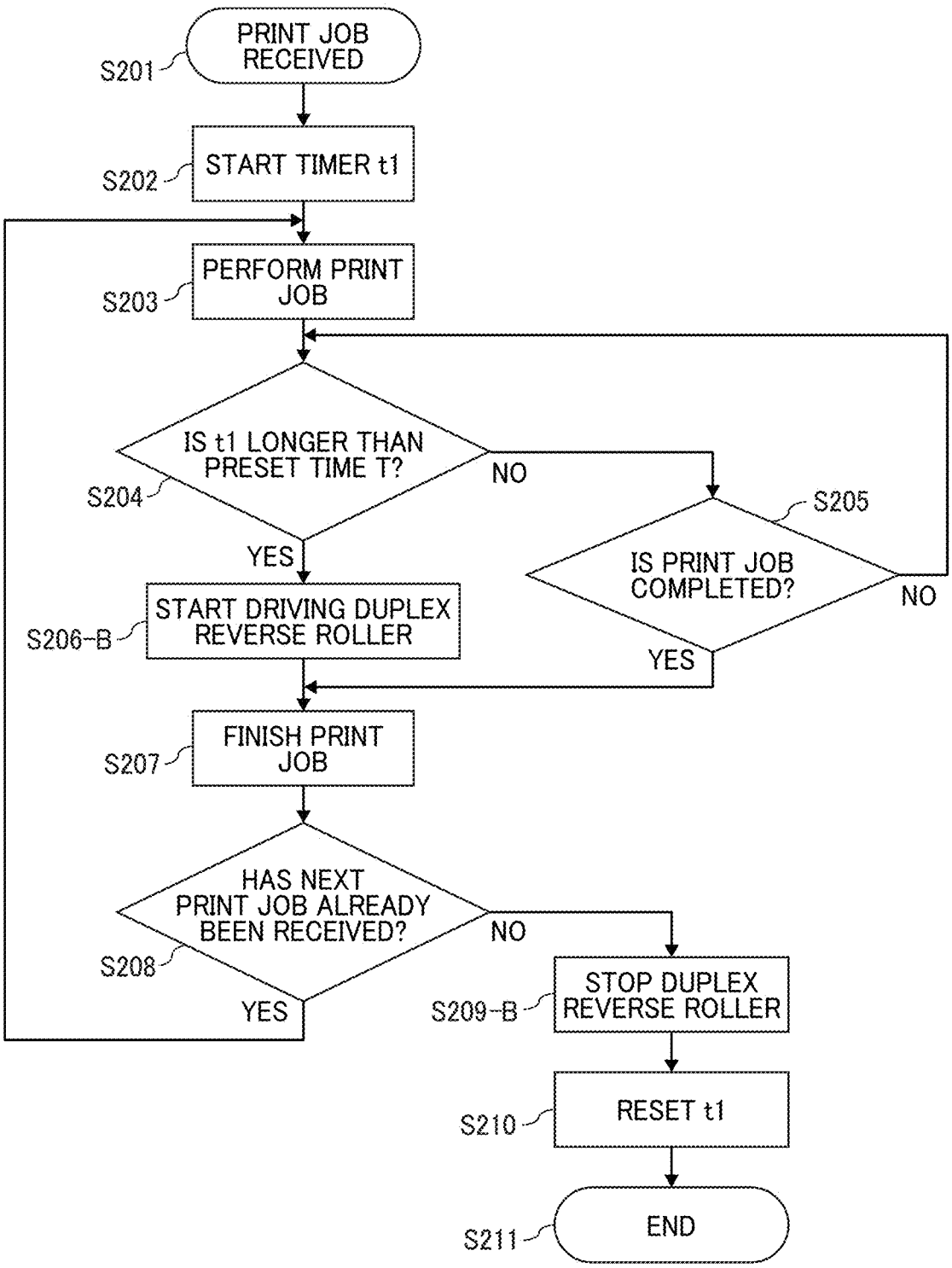
FIG. 10 is a flowchart of an operation example in which the rotation of the duplex reverse rollers is started after a preset time has elapsed.

Next, an operation example of drive control of the conveying members is described. Here, control of the duplex reverse rollers 33*a* as an example of the conveying members is described. FIG. 10 is a flowchart of an operation example in which rotation of the duplex reverse rollers 33*a* is started after the preset time T has elapsed. As described in the operation example of FIG. 8, blowing air while rotating the duplex reverse rollers 33*a* enhances the effect of removing water droplets. The driving of the conveyance rollers may increase noise, and wear of the conveyance rollers may shorten the usable product life of the conveyance rollers. For this reason, in addition to reducing the amount of moisture adhering to the conveying member, minimizing the operation time is also important.

As described in the operation example of FIG. 9, when several sheets are printed, the amount of water vapor generated is small, and thus the risk of occurrence of the condensation image is small. Therefore, controlling driving of the rollers depending on whether the print duration time t1 exceeds any preset time T is effective. Controlled objects in the operation example of the drive control of the duplex reverse rollers 33*a* in FIG. 10 are different from controlled objects in FIG. 9. In FIG. 10, the duplex reverse rollers 33*a* are driven in step S206-B and the duplex reverse rollers 33*a* are stopped in step S209-B. Since other operations are the same as in FIG. 9, the description of the operation example is omitted.

Figure 11:
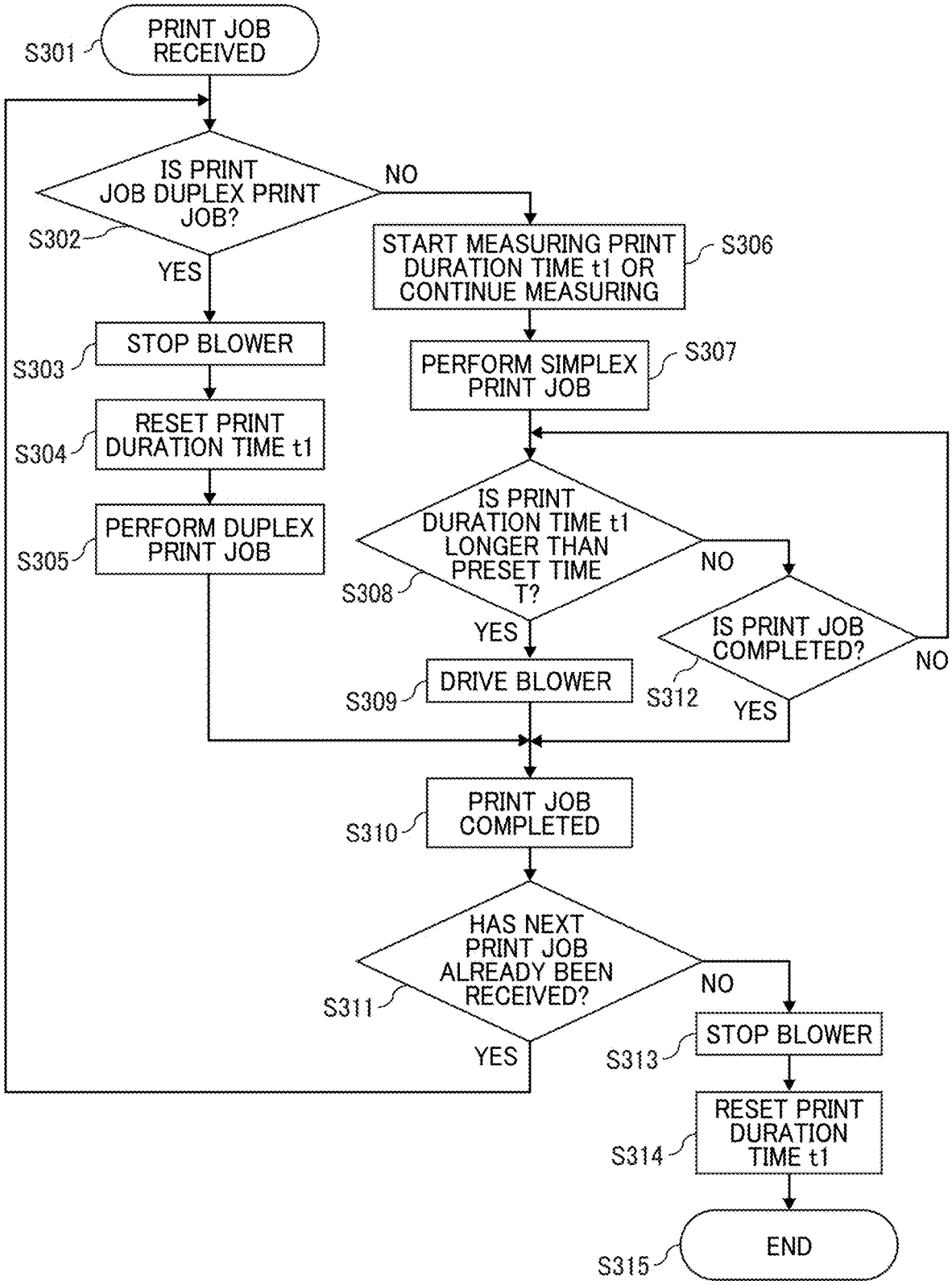
FIG. 11 is a flowchart of an operation example of controlling the operation of the blower according to an elapsed time after the start of printing and the printing mode.

Next, with reference to FIG. 11, an operation example of the operation control of the blower 42 according to the print duration time t1 elapsed after the start of printing and the printing mode is described. As a combined form of the operation examples illustrated in FIG. 7 and FIG. 9, an operation example of a specific method of control to operate the blower 42 after the preset time T and at the time of simplex printing is described. As in FIGS. 7 and 8, after receiving a print job (S301), the controller 100 determines the format of the print job (S302). When the print job is duplex printing (YES in S302), the controller 100 does not operate the blower 42 (stops the blower 42 in S303), resets the print duration time t1 (S304), and performs the duplex print operation (S305). In step S304, the print duration time t1 is reset on the assumption that the duplex printing is performed immediately after simplex printing.

On the other hand, in the case of simplex printing (NO in S302), the controller 100 starts a timer and starts measurement of the print duration time t1 (S306). When the timer has already started and the print continuation time t1 is being measured (Yes in step S311 described later), the controller 100 continues the measurement of the print continuation time t1. The controller 100 starts a simplex print operation (S307). The operation from step S308 to step S310 and the operation in step S312 are the same as those in steps S204, S206, S207, and S205 in FIG. 7, and thus description thereof is omitted.

After the print operation of one print job is completed (S310), the controller 100 determines whether a next print job is reserved (S311). When there is no next print job reserved (NO in S311), the controller 100 stops the blower 42 (S313), resets the print duration time t1 (S314) and ends the control (S315). If there is a next print job reserved (YES in S311), the process returns to step S302 to determine the format of the print job (duplex/simplex).

In the case of simplex printing (NO in S302), the controller 100 advances the process to step S308 while maintaining the state (operating state/stopped state) of the blower 42. Since the subsequent operations are the same, the description thereof is omitted.

In the case of a duplex print job (YES in S302), the controller 100 stops the blower 42 (S303), resets the print duration time t1 for a next simplex print job (S304) and performs the duplex print job (S305) and proceeds to step S310. Since the subsequent operations are the same, the description thereof is omitted. As described above, in a case in which the simplex print jobs are continuously performed, the operation of the blower 42 can be started only after the preset time T has elapsed from the start of the simplex print job. Measuring the print duration time t1 only after the simplex print job is started can further increase effects to reduce the print power consumption and noise.

Note that it is also possible to perform control in which the control targets of steps S303, S309, and S313 are changed from the blower 42 to the duplex reverse rollers 33*a*, which is effective to efficiently remove water droplets.

The operation examples described with reference to FIGS. 7 to 11 can be realized by, for example, a program. The program may be stored in a read only memory (ROM) in advance. Alternatively, the image data may be received from outside via the/F unit 130 or the like and held in a storage area (for example, the memory 110) of the image forming apparatus 10. In the controller 100, the central processing unit (CPU) loads a program stored in the ROM or another storage area and executes a group of instructions of the program using the random access memory (RAM) as a work area, thereby implementing the above-described operation example.

In the above-described embodiment, the blower duct 4 having the openings is disposed in the vicinity of the conveying members which are not used in simplex printing, the intake 43 of the blower duct 4 is provided on a rear side of the image forming apparatus 10, and the blower 42 is controlled to be operated in simplex printing. In this way, the amount of moisture adhering to the conveying members can be reduced, and in particular, the amount of moisture adhering to the conveying members during simplex printing can be effectively reduced.

Embodiments of the present disclosure are not limited to the embodiments described above. Within the scope of the present disclosure, it is possible to change, add, and convert each element of the above-described embodiments to contents that can be easily considered by those skilled in the art.

In the above descriptions, the term "printing" in the present disclosure may be used synonymously with, e.g. the terms of "image formation", "recording", "printing", and "image printing".

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus for performing simplex printing and duplex printing on a recording medium, comprising:

a housing;

a conveyance roller disposed on a conveyance path not used in conveyance of the recording medium in simplex printing;

a duct including:

an intake disposed at a first end of the duct, the intake being configured to suck air from outside of the image forming apparatus; and an opening disposed at a second end of the duct different from the first end of the duct, the duct being opposite the conveyance roller;

a blower disposed in the duct, the blower being configured to blow air sucked from the intake to the conveyance roller through the opening; and control circuitry configured to control the blower to blow air to the conveyance roller at least in the simplex printing.

2. The image forming apparatus according to claim 1, wherein the conveyance roller includes a pair of rollers, and the opening is disposed at a position enabling the blower to blow air to at least one roller of the pair of rollers through the opening.

3. The image forming apparatus according to claim 2, wherein the control circuitry is configured to rotate at least one of the pair of rollers in the simplex printing without conveyance of the recording medium.

4. The image forming apparatus according to claim 1, wherein the intake of the duct is disposed on a side of the image forming apparatus.

5. The image forming apparatus according to claim 1, wherein the control circuitry is configured to stop the blower when a recording medium passes the conveyance roller.

6. The image forming apparatus according to claim 1, wherein the control circuitry is configured to set the blower to a stop state at a start of printing, and to set the blower to an operating state after a preset time has elapsed from the start of printing.

7. The image forming apparatus according to claim 1, wherein the control circuitry is configured to set the blower to a stop state at a start of the simplex printing, and to start an operation of the blower after a preset time has elapsed from the start of the simplex printing.

8. The image forming apparatus according to claim 1, wherein the control circuitry is configured to set the blower to an operating state after a preset number of sheets is printed from the start of the simplex printing.

9. The image forming apparatus according to claim 2, wherein the control circuitry is configured to stop the blower when a recording medium passes the conveyance roller.

10. The image forming apparatus according to claim 3, wherein the control circuitry is configured to stop the blower when a recording medium passes the conveyance roller.

11. The image forming apparatus according to claim 4, wherein the control circuitry is configured to stop the blower when a recording medium passes the conveyance roller.

* * * * *